US008462070B2

(12) United States Patent
Wolf

(10) Patent No.: US 8,462,070 B2
(45) Date of Patent: Jun. 11, 2013

(54) ANTENNA HAVING PLANAR CONDUCTING ELEMENTS, ONE OF WHICH HAS A PLURALITY OF ELECTROMAGNETIC RADIATORS AND AN OPEN SLOT

(75) Inventor: Forrest D. Wolf, Reno, NV (US)

(73) Assignee: Pinyon Technologies, Inc., Reno, NV (US)

( * ) Notice: Subject to any disclaimer, the term of this patent is extended or adjusted under 35 U.S.C. 154(b) by 350 days.

(21) Appl. No.: 12/777,103

(22) Filed: May 10, 2010

(65) Prior Publication Data

US 2011/0273336 A1 Nov. 10, 2011

(51) Int. Cl.
*H01Q 9/28* (2006.01)

(52) U.S. Cl.
USPC ..... 343/795; 343/700 MS

(58) Field of Classification Search
USPC ..... 343/700 MS, 795
See application file for complete search history.

(56) References Cited

U.S. PATENT DOCUMENTS 5,532,708 A * 7/1996 Krenz et al. ..... 343/795
6,018,324 A 1/2000 Kitchener
6,956,536 B2 * 10/2005 Lee ..... 343/793
2002/0000940 A1 1/2002 Moren et al.
2003/0231139 A1 12/2003 Tai et al.
2005/0035919 A1 2/2005 Yang et al.
2007/0120751 A1 * 5/2007 Saito et al. ..... 343/702
2008/0198084 A1 8/2008 Yeap

OTHER PUBLICATIONS

International Search Report and Written Opinion dated Aug. 29, 2011 for PCT Application No. PCT/US2011/035963, 11 pp.

* cited by examiner

*Primary Examiner* — Hoanganh Le
(74) *Attorney, Agent, or Firm* — Holland & Hart LLP

(57) ABSTRACT

An antenna includes a dielectric material having i) a first side opposite a second side, and ii) a conductive via therein. A first planar conducting element is on the first side of the dielectric material and has an electrical connection to the conductive via. A second planar conducting element is also on the first side of the dielectric material. A gap electrically isolates the first and second planar conducting elements from each other. An electrical microstrip feed line on the second side of the dielectric material electrically connects to the conductive via and has a route that extends from the conductive via, to across the gap, to under the second planar conducting element. The first planar conducting element has a plurality of electromagnetic radiators, each having dimensions that cause it to resonate over a range of frequencies that differs from a range of frequencies over which an adjacent radiator resonates. At least first and second of the radiators bound an open slot in the first planar conducting element. The open slot has an orientation perpendicular to the gap.

18 Claims, 7 Drawing Sheets

ANTENNA HAVING PLANAR CONDUCTING ELEMENTS, ONE OF WHICH HAS A PLURALITY OF ELECTROMAGNETIC RADIATORS AND AN OPEN SLOT

BACKGROUND

A dipole antenna is a useful antenna for receiving or transmitting radio frequency radiation. However, a dipole antenna operates in only one frequency band, and antennas that operate in multiple bands are sometimes needed. For example, an antenna that operates in multiple bands is often needed for Worldwide Interoperability for Microwave Access (WiMAX), Ultra Wideband (UWB), Wireless Fidelity (Wi-Fi), ZigBee and Long Term Evolution (LTE) applications.

SUMMARY

In one embodiment, an antenna comprises a dielectric material having i) a first side opposite a second side, and ii) a conductive via therein. A first planar conducting element is on the first side of the dielectric material and has an electrical connection to the conductive via. A second planar conducting element is also on the first side of the dielectric material, and is electrically isolated from the first planar conducting element by a gap. An electrical microstrip feed line is on the second side of the dielectric material. The electrical microstrip feed line electrically connects to the conductive via and has a route extending from the conductive via, to across the gap, to under the second planar conducting element. The second planar conducting element provides a reference plane for both the electrical microstrip feed line and the first planar conducting element. The first planar conducting element has a plurality of electromagnetic radiators. Each radiator has dimensions that cause it to resonate over a range of frequencies that differs from a range of frequencies over which an adjacent radiator resonates. At least first and second of the radiators bound an open slot in the first planar conducting element. The open slot has an orientation perpendicular to the gap.

In another embodiment, an antenna comprises a dielectric material having i) a first side opposite a second side, and ii) a conductive via therein. A first planar conducting element is on the first side of the dielectric material. The first planar conducting element has i) an electrical connection to the conductive via, and ii) a first edge opposite a second edge. The second edge is a stepped edge, wherein each step defines an electromagnetic radiator or an open slot in the first planar conducting element. A second planar conducting element is also on the first side of the dielectric material, and is electrically isolated from the first planar conducting element by a gap. The first edge of the first planar conducting element abuts the gap. An electrical microstrip feed line is on the second side of the dielectric material. The electrical microstrip feed line electrically connects to the conductive via and has a route extending from the conductive via, to across the gap, to under the second planar conducting element. The second planar conducting element provides a reference plane for both the electrical microstrip feed line and the first planar conducting element.

Other embodiments are also disclosed.

BRIEF DESCRIPTION OF THE DRAWINGS

Illustrative embodiments of the invention are illustrated in the drawings, in which.

In the drawings, like reference numbers in different figures are used to indicate the existence of like (or similar) elements in different figures.

DETAILED DESCRIPTION

Figure 1:
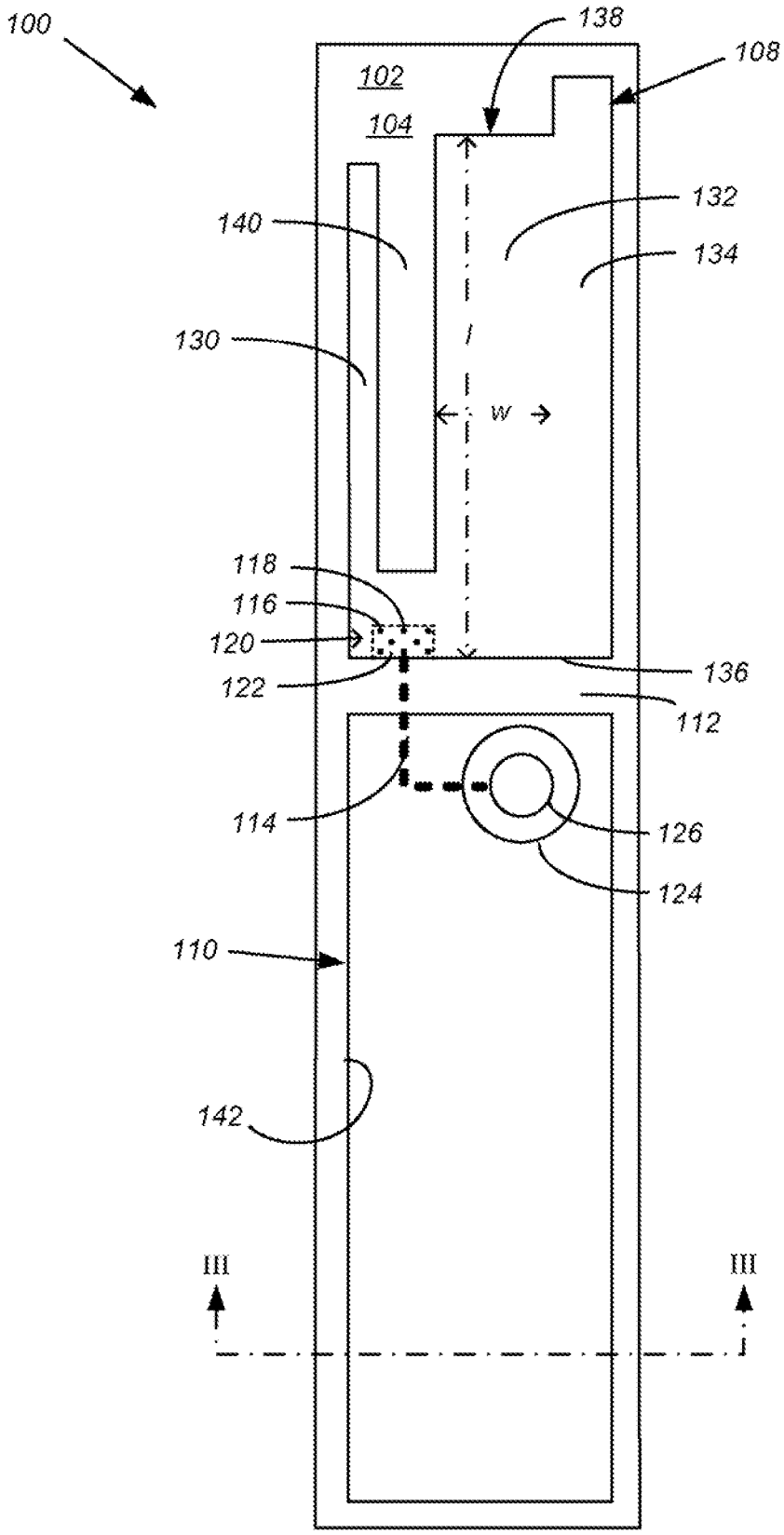
FIGS. 1-3 illustrate a first exemplary embodiment of an antenna having first and second planar conducting elements, one of which comprises a plurality of electromagnetic radiators and an open slot and is electrically connected to an electrical microstrip feed line.
Figure 2:
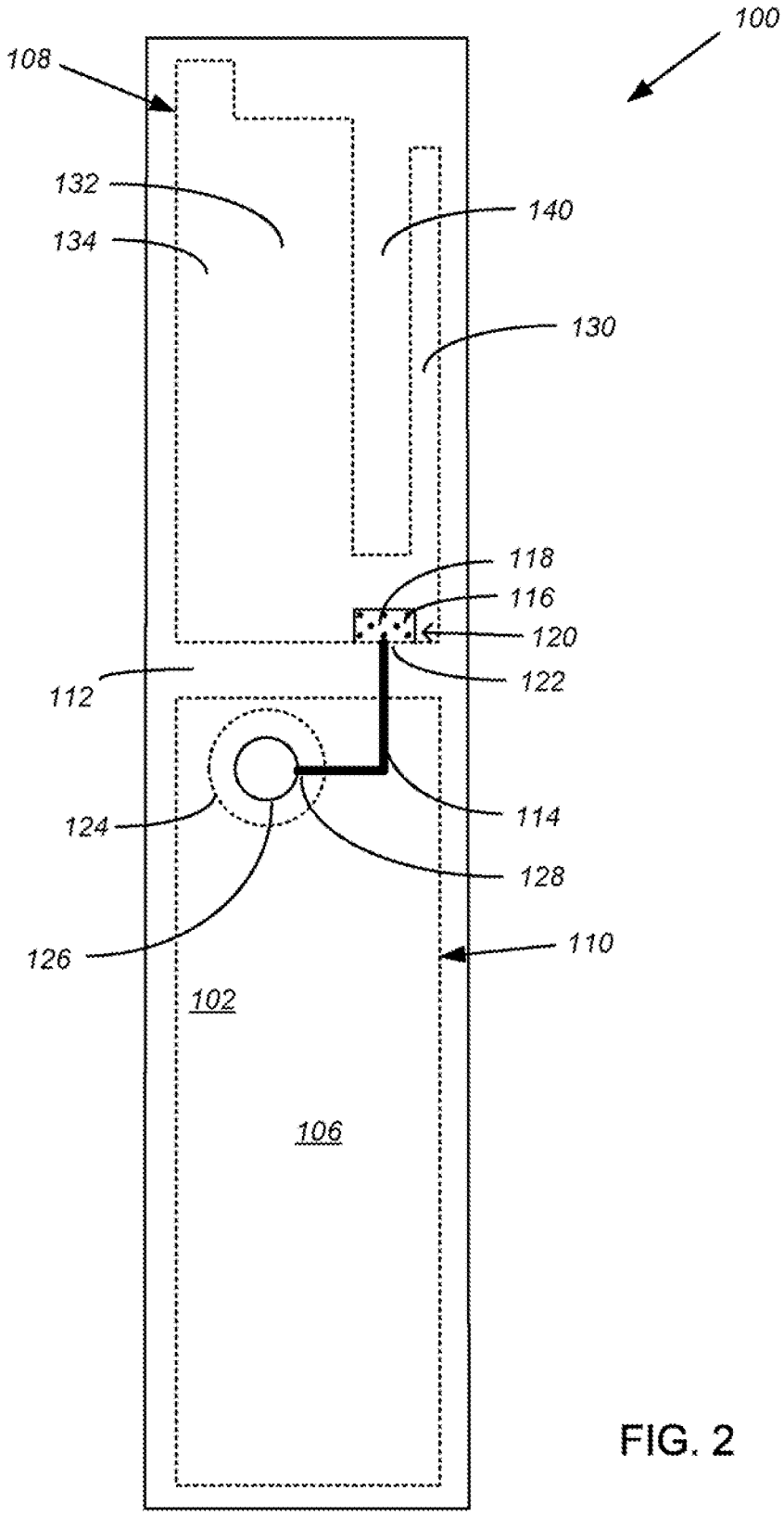
Figure 3:
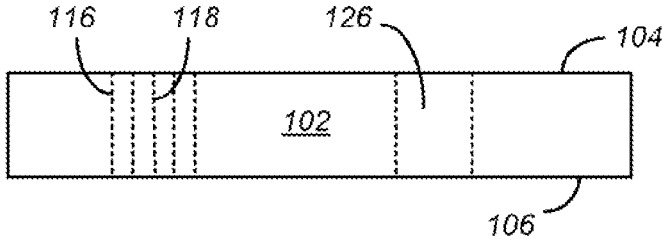

FIGS. 1-3 illustrate a first exemplary embodiment of an antenna 100. The antenna 100 comprises a dielectric material 102 having a first side 104 and a second side 106 (see FIG. 3). The second side 106 is opposite the first side 104. By way of example, the dielectric material 102 may be formed of (or may comprise) FR4, plastic, glass, ceramic, or composite materials such as those containing silica or hydrocarbon. The thickness of the dielectric material 102 may vary, but in some embodiments is equal to (or about equal to) 0.060" (1.524 millimeters).

First and second planar conducting elements 108, 110 (FIG. 1) are disposed on the first side 104 of the dielectric material 102. The first and second planar conducting elements 108, 110 are separated by a gap 112 that electrically isolates the first planar conducting element 108 from the second planar conducting element 110. By way of example, each of the first and second planar conducting elements 108, 110 may be metallic and formed of (or may comprise) copper, aluminum or gold. In some cases, the first and second planar conducting elements 108, 110 may be printed or otherwise formed on the dielectric material 102 using, for example, printed circuit board construction techniques; or, the first and second planar conducting elements 108, 110 may be attached to the dielectric material 102 using, for example, an adhesive.

An electrical microstrip feed line 114 (FIG. 2) is disposed on the second side 106 of the dielectric material 102. By way of example, the electrical microstrip feed line 114 may be printed or otherwise formed on the dielectric material 102 using, for example, printed circuit board construction techniques; or, the electrical microstrip feed line may be attached to the dielectric material 102 using, for example, an adhesive.

The dielectric material 102 has a plurality of conductive vias (e.g., vias 116, 118) therein, with each of the conductive vias 116, 118 being positioned proximate others of the conductive vias at a connection site 120. The first planar conducting element 108 and the electrical microstrip feed line 114 are each electrically connected to the plurality of conductive vias 116, 118, and are thereby electrically connected to one another. By way of example, the first planar conducting element 108 is electrically connected directly to the plurality of conductive vias 116, 118, whereas the electrical microstrip feed line 114 is electrically connected to the plurality of conductive vias 116, 118 by a rectangular conductive pad 122 that connects the electrical microstrip feed line 114 to the plurality of conductive vias 116, 118.

As best shown in FIG. 2, the electrical microstrip feed line 114 has a route that extends from the plurality of conductive vias 116, 118, to across the gap 112 (that is, the route crosses the gap 112), to under the second planar conducting element 110. In this manner, the second planar conducting element 110 provides a reference plane for the electrical microstrip feed line 114.

The first planar conducting element 108 has a plurality of electromagnetic radiators. By way of example, the first planar conducting element 108 is shown to have three electromagnetic radiators 130, 132, 134. In other embodiments, the first planar conducting element 108 could have any number of two or more electromagnetic radiators.

Each of the radiators 130, 132, 134 has dimensions (e.g., radiator 132 has dimensions "w" and "l") that cause it to resonate over a range of frequencies that differs from a range of frequencies over which one or more adjacent radiators resonate. At least some of the frequencies in each range of frequencies differ from at least some of the frequencies in one or more other ranges of frequencies. In this manner, and during operation, each of the radiators 130, 132, 134 is capable of receiving different frequency signals and energizing the electrical microstrip feed line 114 in response to the received signals (in receive mode). Combinations of radiators may at times simultaneously energize the electrical microstrip feed line 114. In a similar fashion, a radio connected to the electrical microstrip feed line 114 may energize any of (or multiple ones of) the radiators 130, 132, 134, depending on the frequency (or frequencies) at which the radio operates in transmit mode.

By way of example, each of the radiators 130, 132, 134 shown in FIGS. 1 & 2 has a length, a width, and a rectangular shape. The lengths of the radiators 130, 132, 134 are oriented perpendicular to the gap 112 and extend between first and second opposite edges 136, 138 of the first planar conducting element 108. Because adjacent radiators have different lengths, the second edge has a stepped configuration (i.e., is a stepped edge). As shown in FIGS. 1 & 2, the stepped edge 138 is composed of a plurality of flat edge segments. In other embodiments, the radiators 130, 132, 134 could have other shapes, and the stepped edge 138 could take other forms. For example, each of its edge segments could be convex or concave, or the corners of the stepped edge 138 could be rounded or beveled. The edge 136 abuts the gap 112.

First and second ones of the radiators 130, 132 bound an open slot 140 in the first planar conducting element 108. The open slot 140 has an orientation that is perpendicular to the gap 112. Thus, the open slot 140 opens away from the gap 112.

By way of example, the second and third radiators 132, 134 shown in FIGS. 1 & 2 abut each other (i.e., there is no slot between them). In other embodiments, a slot could be provided between each pair of adjacent radiators (e.g., between radiators 130 and 132, and between radiators 132 and 134.

The widths and lengths of the radiators 130, 132, 134 may be chosen to cause each radiator 130, 132, 134 to resonate over a particular range of frequencies. By way of example, and in the antenna 100, the length of the second radiator 132 is greater than the length of the first radiator 130, and the length of the third radiator 134 is greater than the length of the second radiator 132.

The second planar conducting element 110 provides a reference plane for both the electrical microstrip feed line 114 and the first planar conducting element 108, and in some embodiments may have a rectangular perimeter 142.

As shown in FIGS. 1 & 2, the second planar conducting element 110 has a hole 124 therein. The dielectric material 102 has a hole 126 therein. By way of example, the holes 124, 126 are shown to be concentric and round. The hole 124 in the second planar conducting element 110 is larger than the hole 126 in the dielectric material 102, thereby exposing the first side 104 of the dielectric material 102 in an area adjacent the hole 126 in the dielectric material 102.

Figure 4:
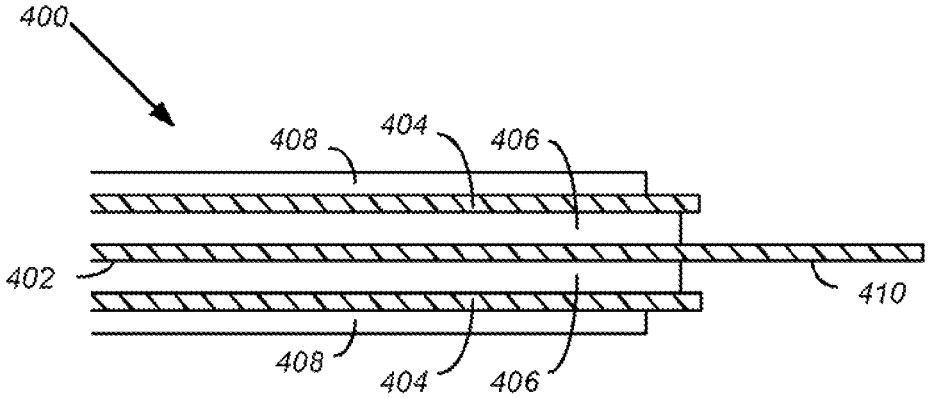
FIG. 4 illustrates a portion of a cross-section of an exemplary coax cable that may be electrically connected to the antenna shown in FIGS. 1-3.
Figure 7:
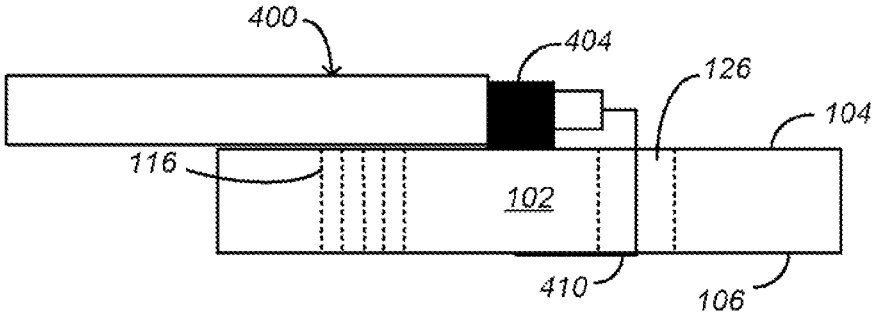
FIGS. 5-7 illustrate an exemplary connection of the coax cable shown in FIG. 4 to the antenna shown in FIGS. 1-3.
Figure 5:
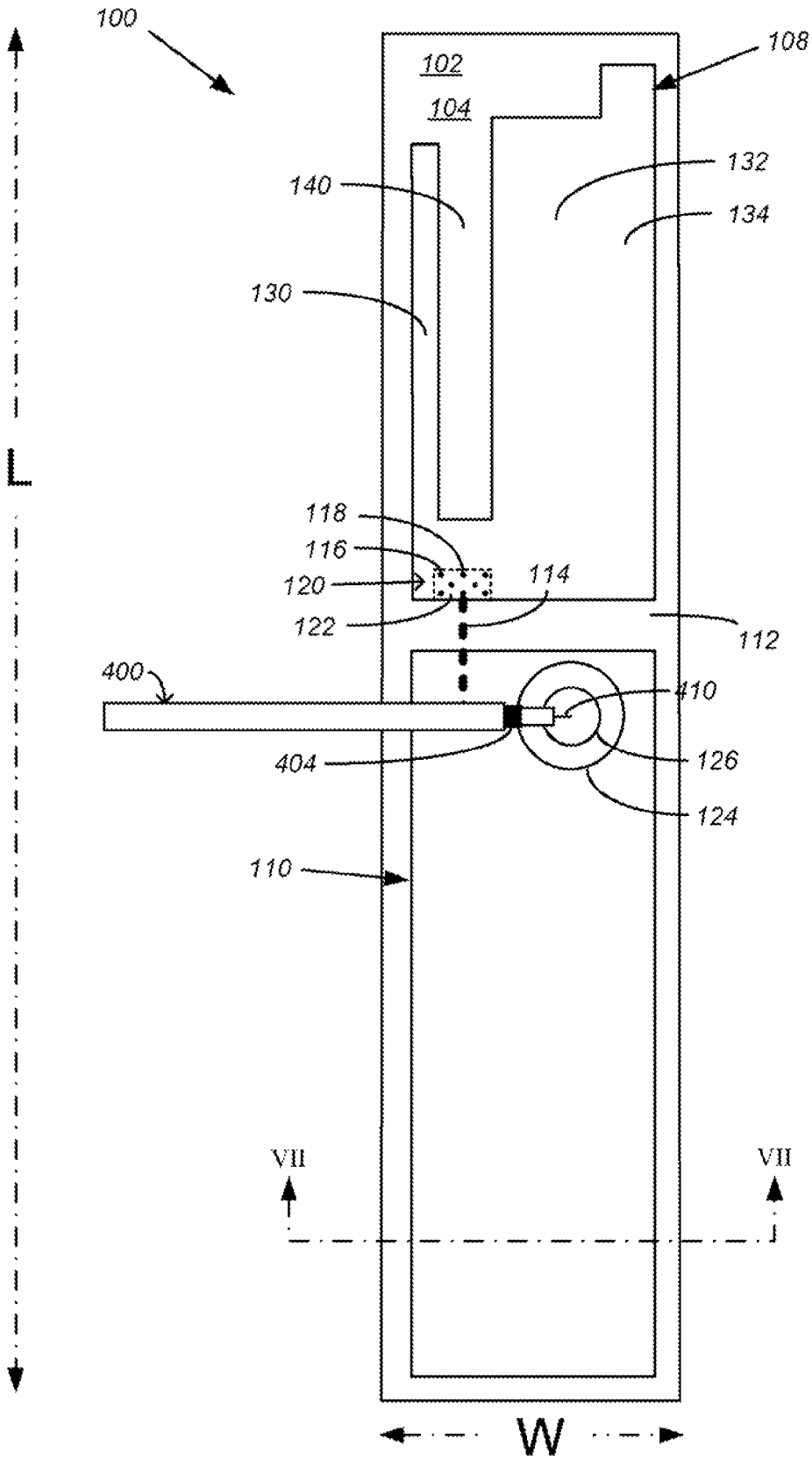
Figure 6:
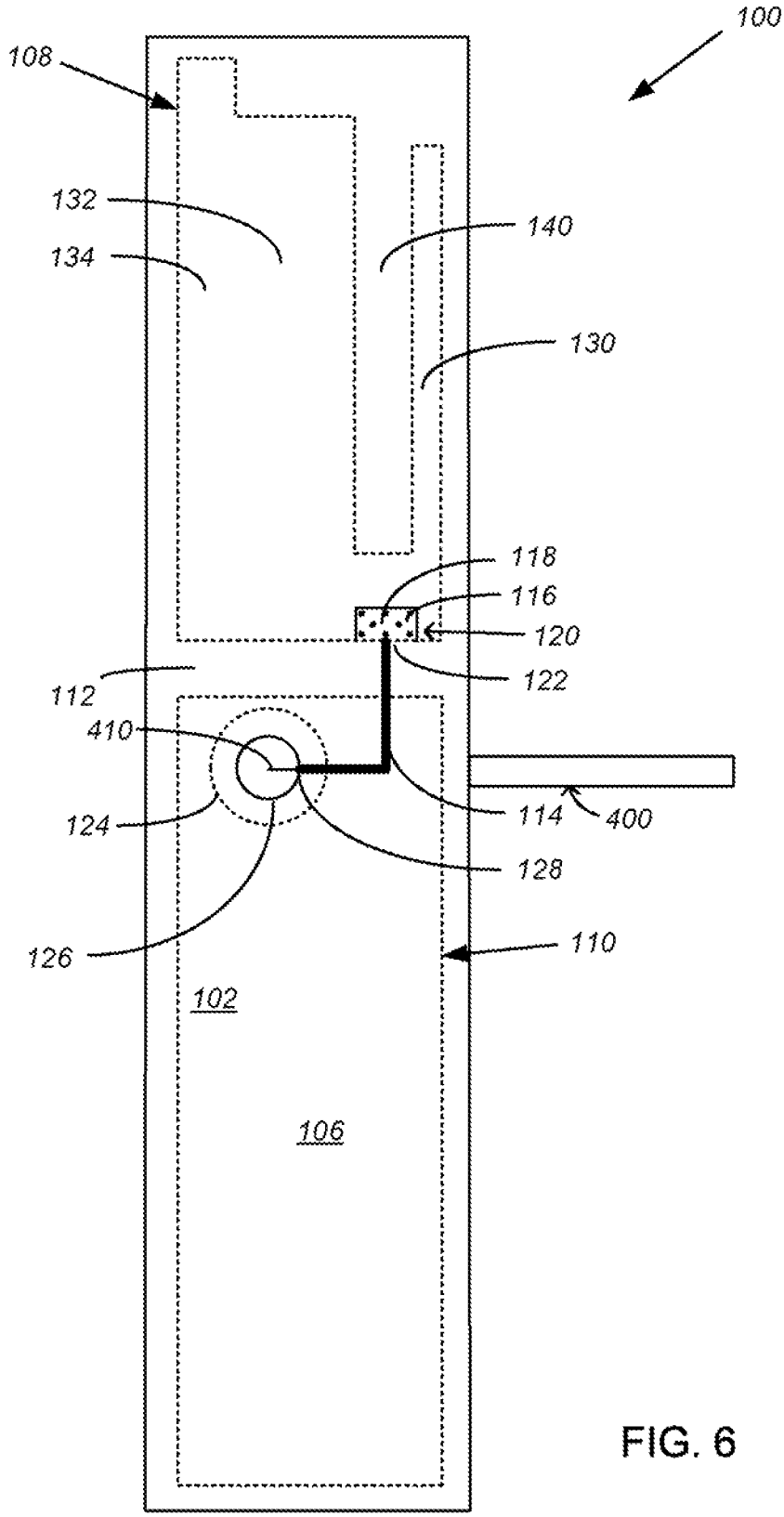

FIG. 4 illustrates a cross-section of a portion of an exemplary coax cable 400 that may be attached to the antenna 100, as shown in FIGS. 5-7. The coax cable 400 (FIG. 4) has a center conductor 402, a conductive sheath 404, and a dielectric 406 that separates the center conductor 402 from the conductive sheath 404. The coax cable 400 may also comprise an outer dielectric jacket 408. A portion 410 of the center conductor 402 extends from the conductive sheath 404 and the dielectric 406. The coax cable 400 is electrically connected to the antenna 100 by positioning the coax cable 400 adjacent the first side 104 of the antenna 100 and inserting the portion 410 of its center conductor 402 through the holes 124, 126 (see FIGS. 5 & 7). The center conductor 402 is then electrically connected to the electrical microstrip feed line 114 by, for example, soldering, brazing or conductively bonding the portion 410 of the center conductor 402 to the electrical microstrip feed line 114 (see FIGS. 6 & 7). The conductive sheath 404 of the coax cable 400 is electrically connected to the second planar conducting element 110 (also, for example, by way of soldering, brazing or conductively bonding the conductive sheath 404 to the second planar conducting element 110; see FIGS. 5 & 7). The exposed ring of dielectric material 102 adjacent the hole 126 in the dielectric material 102 can be useful in that it prevents the center conductor 402 of the coax cable 400 from shorting to the conductive shield 404 of the coax cable 400. In some embodiments, the coax cable 400 may be a 50 Ohm (Ω) coax cable.

The antenna 100 has a length, L, extending from the first planar conducting element 108 to the second planar conducting element 110. The length, L, crosses the gap 112. The antenna 100 has a width, W, that is perpendicular to the length. The coax cable 400 follows a route that is parallel to the width of the antenna 100. The coax cable 400 is urged along the route by the electrical connection of its conductive sheath 404 to the second planar conducting element 110, or by the electrical connection of its center conductor 402 to the electrical microstrip feed line 114.

In the antenna shown in FIGS. 1-3 & 5-7, the route of the electrical microstrip feed line 114 changes direction under the second planar conducting element 110. More specifically, the route of the electrical microstrip feed line 114 crosses the gap 112 parallel to the length of the antenna 100, then changes direction and extends parallel to the width of the antenna 100. The electrical microstrip feed line 114 may generally extend from the plurality of conductive vias 116, 118 to a termination point 128 adjacent the hole 126 in the dielectric material 102.

As previously mentioned, each of the radiators 130, 132, 134 of the first planar conducting element 108 has dimensions that cause it to resonate over a range of frequencies. The center frequencies and bandwidths of each frequency range can be configured by adjusting, for example, the length and width of each radiator 130, 132, 134. Although the perimeter of the first planar conducting element 108 is shown to have a plurality of straight edges, some or all of the edges may alternately be curved, or the perimeter of the first planar conducting element 108 may have a shape with a continuous curve. The center frequency and bandwidth of each frequency range can also be configured by configuring the positions and relationships of the radiators 130, 132, 134 with respect to each other, or with respect to one or more open slots 140.

Although the perimeter 142 of the second planar conducting element 110 is shown to have a plurality of straight edges, some or all of the edges may alternately be curved, or the perimeter 142 of the second planar conducting element 110 may have a shape with a continuous curve.

An advantage of the antenna 100 shown in FIGS. 1-3 & 5-7 is that the antenna 100 operates in multiple bands, and with an omni-directional azimuth, small size and high gain. By way of example, the antenna 100 shown in FIGS. 1-3 & 5-7 has been constructed in a form factor having a width of about 7 millimeters (7 mm) and a length of about 38 mm. In such a form factor, and with the first and second planar conducting elements 108, 110 configured as shown in FIGS. 1-3 & 5-7, the first radiator 130 has been configured to resonate in a first range of frequencies extending from about 3.3 Gigahertz (GHz) to 3.8 GHz, the second radiator 132 has been configured to resonate in a second range of frequencies extending from about 2.5 GHz to 2.7 GHz, and the third radiator 134 has been configured to resonate in a third range of frequencies extending from about 2.3 to 2.7 GHz. Such an antenna is therefore capable of operating as a WiMAX or LTE antenna, resonating at or about the commonly used center frequencies of 2.3 GHz, 2.5 GHz and 3.5 GHz.

The antenna 100 shown in FIGS. 1-3 & 5-7 may be modified in various ways for various purposes. For example, the perimeters of the first and second planar conducting elements 108, 110 may take alternate forms, such as forms having: more or fewer edges than shown in FIGS. 1, 2, 5 & 6; straight or curved edges; or continuously curved perimeters. In some embodiments, the shape of either or both of the planar conducting elements 108, 110, the shape of part of a planar conducting element 108, 110, or the shape of a slot 140, may be defined by one or more interconnected rectangular conducting segments or slot segments. In some embodiments, the first planar conducting element 108 may be modified to have more or fewer slots.

For the antenna 100 shown in FIGS. 1-6, the dimensions of the electromagnetic radiators 130, 132, 134 cause the radiators to resonate over non-overlapping (or substantially non-overlapping) frequency ranges. However, in some embodiments, the radiators 130, 132, 134 could be sized or shaped to resonate over overlapping frequency ranges.

In some embodiments, the holes 124, 126 in the second planar conducting element 110 and dielectric material 102 may be sized, positioned and aligned as shown in FIGS. 1, 2, 5 & 6. In other embodiments, the holes 124, 126 may be sized, positioned or aligned in different ways. As defined herein, "aligned" holes are holes that at least partially overlap, so that an object may be inserted through the aligned holes. Though FIG. 1 illustrates holes 124, 126 that are sized and aligned such that the first side 104 of the dielectric material 102 is exposed adjacent the hole 126 in the dielectric material 102, the first side 104 of the dielectric material 102 need not be exposed adjacent the hole 126.

In some embodiments, the plurality of conductive vias 116, 118 shown in FIGS. 1, 2, 5 & 6 may comprise more or fewer vias; and in some cases, the plurality of conductive vias 116, 118 may consist of only one conductive via. Despite the number of conductive vias 116, 118 provided at a connection site 120, the rectangular conductive pad 122 may be replaced by a conductive pad having another shape; or, one or more conductive vias 116, 118 may be electrically connected directly to the electrical microstrip feed line 114 (i.e., without use of the pad 122). In some embodiments, the via(s) 116, 118 are located between the open slot 140 and the gap 112 (though in other embodiments, the via(s) 116, 118 can be located in other positions).

In FIGS. 1, 2, 5 & 6, and by way of example, the gap 112 between the first and second planar conducting elements 108, 110 is shown to be rectangular and of uniform width.

The operating bands of an antenna that is constructed as described herein may be contiguous or non-contiguous. In some cases, each operating band may cover part or all of a standard operating band, or multiple standard operating bands. However, it is noted that increasing the range of an operating band can in some cases narrow the gain of the operating band.

Figure 8:
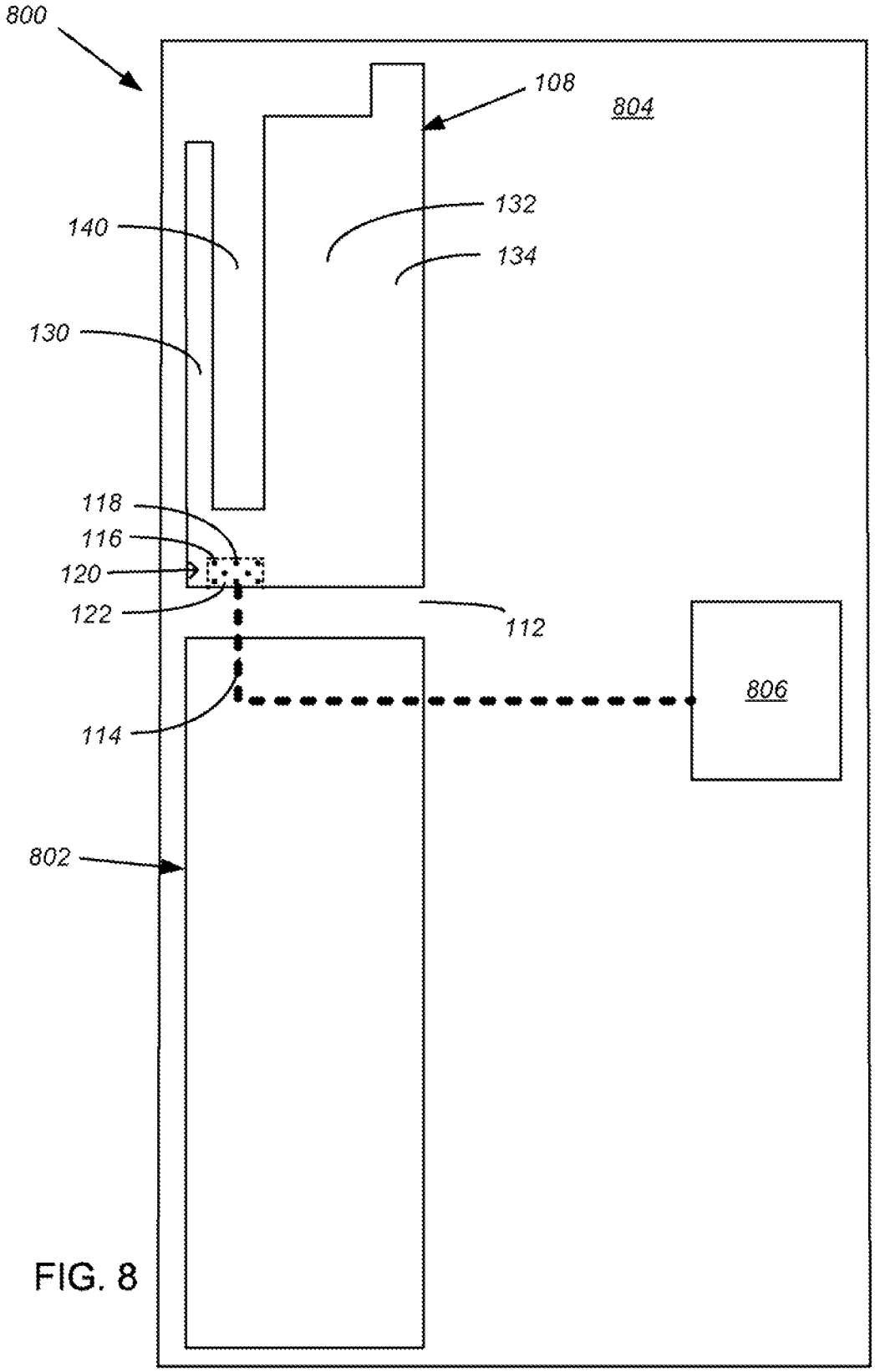
FIGS. 8 & 9 illustrate a second exemplary embodiment of an antenna having first and second planar conducting elements, one of which comprises a plurality of electromagnetic radiators and an open slot and is electrically connected to an electrical microstrip feed line.
Figure 9:
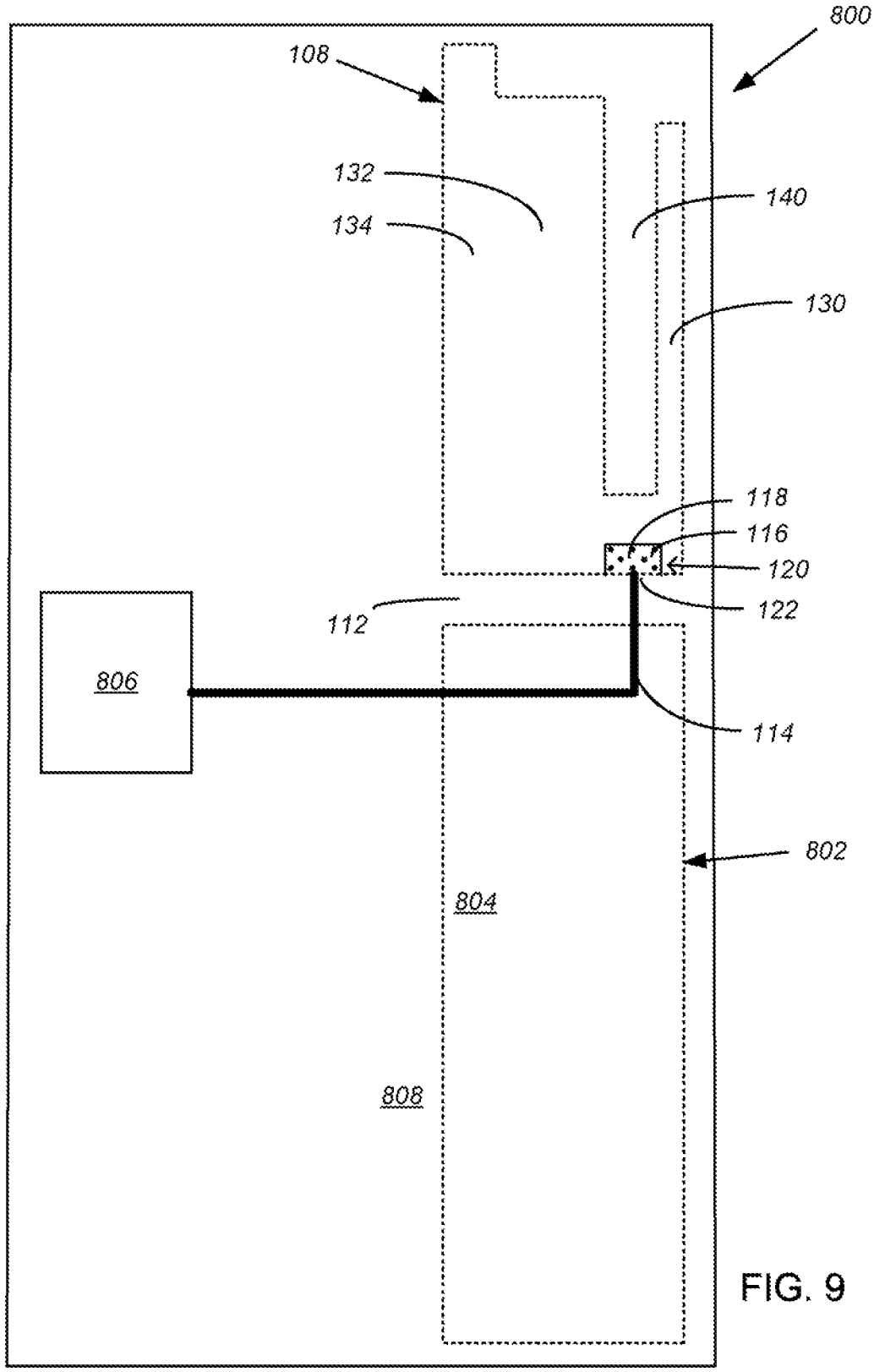

FIGS. 8 & 9 illustrate a variation 800 of the antenna 100 shown in FIGS. 1-3 & 5-7, wherein the holes in the second planar conducting element 802 and dielectric material 804, and the coax cable passing through the holes, have been eliminated. The electrical microstrip feed line 114 is extended, or another feed line (e.g., another microstrip feed line) is joined to it, to electrically connect the electrical microstrip feed line 114 to a radio 806. The second planar conducting element 804 may be connected to a ground potential, such as a system or local ground, that is shared by the radio 806.

In some cases, the radio 806 may be mounted on the same dielectric material 804 as the antenna 800. To avoid the use of additional conductive vias or other electrical connection elements, the radio 806 may be mounted on the second side 808 of the dielectric material 804 (i.e., on the same side of the dielectric material 804 as the electrical microstrip feed line 114). The radio 806 may comprise an integrated circuit.

What is claimed is:

1. An antenna, comprising:

a dielectric material having i) a first side opposite a second side, and ii) a conductive via therein;

a first planar conducting element on the first side of the dielectric material, the first planar conducting element having an electrical connection to the conductive via;

a second planar conducting element on the first side of the dielectric material, wherein the first and second planar conducting elements are separated by a gap that electrically isolates the first planar conducting element from the second planar conducting element; and an electrical microstrip feed line on the second side of the dielectric material, the electrical microstrip feed line electrically connected to the conductive via and having a route extending from the conductive via, to across the gap, to under the second planar conducting element, the route changing direction under the second planar conducting element on the second side of the dielectric material, the second planar conducting element providing a reference plane for both the electrical microstrip feed line and the first planar conducting element;

wherein the first planar conducting element has a plurality of electromagnetic radiators, each radiator having dimensions that cause it to resonate over a range of frequencies that differs from a range of frequencies over which an adjacent radiator resonates, and at least first and second of the radiators bounding an open slot in the first planar conducting element, wherein the slot has an orientation perpendicular to the gap.

2. The antenna of claim 1, wherein each radiator has a length and a width, the lengths of the radiators having orientations perpendicular to the gap.

3. The antenna of claim 1, wherein a third of the radiators abuts the second of the radiators.

4. The antenna of claim 3, wherein the length of the second radiator is greater than the length of the first radiator, and wherein the length of the third radiator is greater than the length of the second radiator.

5. The antenna of claim 1, wherein the first planar conducting element electrically connects to the conductive via between the open slot and the gap.

6. The antenna of claim 1, wherein the first planar conducting element has a third radiator.

7. The antenna of claim 1, wherein the second planar conducting element has a rectangular perimeter.

8. The antenna of claim 1, wherein each of the radiators has a rectangular shape.

9. The antenna of claim 1, wherein the dielectric material comprises FR4.

10. The antenna of claim 1, wherein the second planar conducting element has a hole therein, and the dielectric material has a hole therein, the hole in the second planar conducting element and the hole in the dielectric material being aligned.

11. The antenna of claim 10, further comprising a coax cable having a center conductor, a conductive sheath, and a dielectric separating the center conductor from the conductive sheath, wherein the center conductor extends through the hole in the second planar conducting element and the hole in the dielectric material, wherein the center conductor is electrically connected to the electrical microstrip feed line, and wherein the conductive sheath is electrically connected to the second planar conducting element.

12. The antenna of claim 11, wherein:

the antenna has a length extending from the first planar conducting element to the second planar conducting element, the length crossing the gap;

the antenna has a width perpendicular to the length; and the coax cable follows a route that is parallel to the width of the antenna, the coax cable being urged along the route by the electrical connection of the conductive sheath to the second planar conducting element.

13. The antenna of claim 1, wherein:

the antenna has a length extending from the first planar conducting element to the second planar conducting element, the length crossing the gap;

the antenna has a width perpendicular to the length; and the route of the electrical microstrip feed line crosses the gap parallel to said length, then changes direction and extends parallel to said width.

14. The antenna of claim 1, wherein:

the dielectric material has a plurality of conductive vias therein, of which the conductive via is one, and wherein each of the plurality of conductive vias is positioned proximate to others of the conductive vias at a connection site; and each of the electrical microstrip feed line and the first planar conducting element is electrically connected to each of the plurality of conductive vias.

15. The antenna of claim 1, further comprising a radio on the dielectric material, wherein the electrical microstrip feed line is electrically connected to the radio.

16. The antenna of claim 15, wherein the radio is on the second side of the dielectric material.

17. The antenna of claim 15, wherein the radio comprises an integrated circuit.

18. An antenna, comprising:

a dielectric material having i) a first side opposite a second side, and ii) a conductive via therein;

a first planar conducting element on the first side of the dielectric material, the first planar conducting element having an electrical connection to the conductive via;

a second planar conducting element on the first side of the dielectric material, wherein the first and second planar conducting elements are separated by a gap that electrically isolates the first planar conducting element from the second planar conducting element; and an electrical microstrip feed line on the second side of the dielectric material, the electrical microstrip feed line electrically connected to the conductive via and having a route extending from the conductive via, to across the gap, to under the second planar conducting element, the second planar conducting element providing a reference plane for both the electrical microstrip feed line and the first planar conducting element;

wherein the first planar conducting element has a plurality of electromagnetic radiators, each radiator having dimensions that cause it to resonate over a range of frequencies that differs from a range of frequencies over which an adjacent radiator resonates, and at least first and second of the radiators bounding an open slot in the first planar conducting element, wherein the open slot has an orientation perpendicular to the gap;

wherein the second planar conducting element has a hole therein, and the dielectric material has a hole therein, the hole in the second planar conducting element and the hole in the dielectric material being aligned; and wherein the hole in the second planar conducting element is larger than the hole in the dielectric material, thereby exposing the first side of the dielectric material adjacent the hole in the dielectric material.

* * * * *